US007577373B2

(12) United States Patent
Ishii

(10) Patent No.: US 7,577,373 B2
(45) Date of Patent: Aug. 18, 2009

(54) IMAGE FORMING APPARATUS HAVING WARM-UP AND NORMAL MODES AND CONTROL METHOD THEREOF

(75) Inventor: Mitsunori Ishii, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 361 days.

(21) Appl. No.: 11/280,000

(22) Filed: Apr. 17, 2006

(65) Prior Publication Data

US 2007/0242969 A1 Oct. 18, 2007

(51) Int. Cl.
*G03G 15/20* (2006.01)

(52) U.S. Cl. ..... 399/68; 399/70

(58) Field of Classification Search ..... 399/68, 399/69, 70, 330, 331, 334; 219/216, 469
See application file for complete search history.

(56) References Cited

U.S. PATENT DOCUMENTS 5,512,993 A * 4/1996 Endo et al. ..... 399/335
5,671,462 A * 9/1997 Toyohara et al. ..... 399/33
5,819,134 A * 10/1998 Sato et al. ..... 399/69
5,978,618 A * 11/1999 Yamamoto et al. ..... 399/69
6,311,028 B1 * 10/2001 Matsudaira ..... 399/69
6,516,165 B2 * 2/2003 Makihira et al. ..... 399/69
6,763,206 B2 * 7/2004 Kinouchi et al. ..... 399/70
6,810,220 B2 * 10/2004 Hamada et al. ..... 399/69
7,027,749 B2 * 4/2006 Kamei ..... 399/69
7,092,652 B2 * 8/2006 Matsumoto ..... 399/70
7,130,554 B2 * 10/2006 Takematsu ..... 399/69
7,187,880 B2 * 3/2007 Senda et al. ..... 399/69
7,310,485 B2 * 12/2007 Peng et al. ..... 399/69

FOREIGN PATENT DOCUMENTS

JP 59075271 A * 4/1984
JP 61277986 A * 12/1986
JP 7-325500 12/1995
JP 11-194648 7/1999

* cited by examiner

*Primary Examiner*—Robert Beatty
(74) *Attorney, Agent, or Firm*—SoCal IP Law Group LLP; Steven C. Sereboff; John E. Gunther

(57) ABSTRACT

An image forming apparatus includes: a conveyance motor for conveying paper; an image forming unit forms a toner image on the conveyed paper; and a fixing device having a heat roller including plural heat sources to cause the toner image to be fixed to the paper. The image forming apparatus also includes a control unit. The control unit generates a control signal that switches ON or OFF the heat sources and a signal controls the driving of the conveyance motor, and generates a mode signal that differs between a warm-up mode and a normal mode. The control unit switches ON the plural heat sources at the same time and prohibits the driving of the conveyance motor during the warm-up mode, and allows the driving of the conveyance motor and prohibits all of the plural heat sources from being switched ON at the same time during the normal mode.

12 Claims, 6 Drawing Sheets

IMAGE FORMING APPARATUS HAVING WARM-UP AND NORMAL MODES AND CONTROL METHOD THEREOF

BACKGROUND OF THE INVENTION

1. Field of the Invention

The present invention relates to an image forming apparatus, such as an MFP (Multi-Function Peripherals) that is a digital multifunction machine, a copier, and a printer, and to a control method, and suppresses abnormal temperature rises while realizing a shortening of warm-up time and an improvement in printing speed.

2. Description of the Related Art

In image forming apparatus such as MFPs, copiers, and printers, usually a fixing device is used because a toner image is formed on paper and the toner image is fixed to the paper. The fixing device includes a heat roller for heating and a pressure roller, and the unfixed paper is conveyed between this pair of rollers. Incidentally, because the fixing device is cool when the power is switched ON and the like, the fixing device is warmed by heating the heat roller, but there has been the problem that it takes time for the fixing device to become warm, and this warm-up time is long. Further, in order to improve the printing speed, the conveyance of the paper may conducted at a high speed, but a conveyance motor that can be driven at a high speed becomes necessary.

For this reason, in order to shorten the warm-up time and increase the printing speed, a heater with a large amount of heat and a conveyance motor that can be driven at a high speed may be combined, but when the heater and the conveyance motor are driven at the same time, there is concern that the power consumption will exceed the rating. Moreover, a complicated and expensive control circuit has been used as a safety measure when the temperature of the heater exceeds a stipulated value.

In the image forming apparatus disclosed in Japanese Patent Application Publication No. 11-194648, an example is described where a voltage output circuit that supplies power to the heater of the fixing device is disposed, and the applied voltage is set high when the heater is initially lighted. Further, an example is described where an increase in the power consumption is suppressed by shutting down or reducing the burden such as the motor only at times when the applied voltage is high.

However, in this example, it is necessary to vary the applied voltage using a control IC in order to raise the applied voltage when the heater is initially lighted, and the circuit configuration has been complicated and expensive. Further, because there is one heater, the temperature of the heat roller in the fixing device does not become uniform, and precise temperature control has been impossible when the temperature of the heat roller is different between its central portion and both sides.

Further, in the fixing device disclosed in Japanese Patent Application Publication No. 7-325500, an example is described where the fixing device includes a heat roller and a pressure roller, and plural halogen lamps are disposed inside the heat roller. In this example, the surface temperature of the heat roller is made uniform by the plural halogen lamps inside the heat roller.

However, no consideration is given to controlling the conveyance motor. Consequently, a measure to reduce power consumption that includes both controlling the heater and driving the conveyance motor is not disclosed.

DETAILED DESCRIPTION OF THE INVENTION

Figure 1:
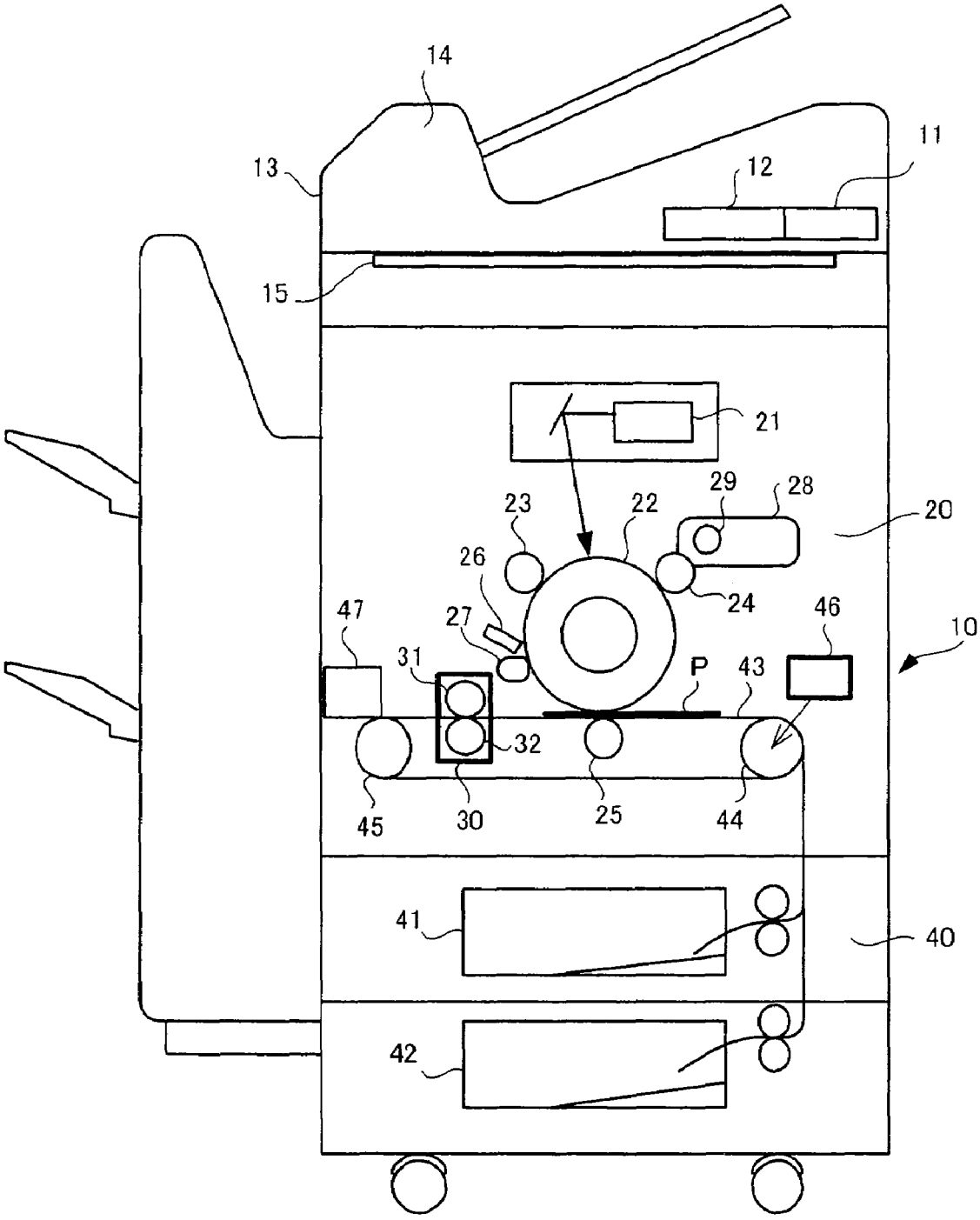
FIG. 1 is an overall configural diagram describing an embodiment of an image forming apparatus of the present invention.

Throughout this description, the embodiments and examples shown should be considered exemplars, rather than limitations on the apparatus and methods of the present invention.

An embodiment of this invention will be described in detail below with reference to the drawings. It will be noted that the same reference numerals are given to the same places in the drawings.

FIG. 1 is a configural diagram showing an embodiment of an image forming apparatus of the present invention. It will be noted that, in the following description, an MFP (Multi-Function Peripherals) that is a multifunction machine will be described as an example, but the present invention can also be applied to printers, copiers, and other image forming apparatus.

In FIG. 1, 10 is an image forming apparatus. The image forming apparatus 10 includes in its central portion a printer unit 20 that is an image forming unit, and includes in its upper portion an operation unit 11, a display unit 12, a scanner unit 13, an automatic document feeder (ADF) 14, and a transparent document platen 15. The image forming apparatus 10 also includes in its lower portion a paper supply unit 40.

The printer unit 20 configuring the image forming unit is a tandem system laser printer, for example.

The printer unit 20 is disposed with a laser 21, irradiates a photoconductor drum 22 with a laser beam from the laser 21, and scans the photoconductor drum 22. A charging device 23, a developing device 24, a transfer device 25, a cleaner 26, and a toner recovery unit 27 are disposed around the photoconductor drum 22. Toner is supplied from a toner cartridge 28 to the developing device 24, and a screw 29 for replenishing the toner is disposed in the toner cartridge 28. It will be noted that, in the case of a color laser printer, the image forming apparatus 10 is disposed with black, cyan, magenta, and yellow developing units.

The surface of the photoconductor drum 22 is uniformly charged by the charging device 23, the photoconductor drum 22 is irradiated with the laser beam from the laser 21, and an electrostatic latent image is formed. The electrostatic latent image is developed by the developing device 24 to form a toner image on the photoconductor drum 22.

Further, the paper supply unit 40 is disposed with plural paper supply cassettes 41 and 42 that accommodate different sizes of paper, and paper P from the paper supply cassettes 41 and 42 is sent to the transfer device 25 by a conveyor belt 43. The conveyor belt 43 circularly moves due to the rotation of rollers 44 and 45 and conveys the paper P. Moreover, a conveyance motor 46 is disposed in order to drive the rollers 44 and 45.

The toner image formed on the photoconductor drum 22 is transferred to the paper P by the transfer device 25, and the paper P is then conveyed to a fixing device 30 by the conveyor belt 43. The fixing device 30 includes a heat roller 31 for heating and a pressure roller 32. The toner image is fixed to the paper P by the heat roller 31 and the pressure roller 32, and a visible image is formed. Then, the paper P that has passed through the fixing device 30 is discharged via a paper discharge unit 47. When there is a finisher at a later stage, processing such as stapling and punching is administered by the finisher, and the paper P is discharged.

Figure 2:
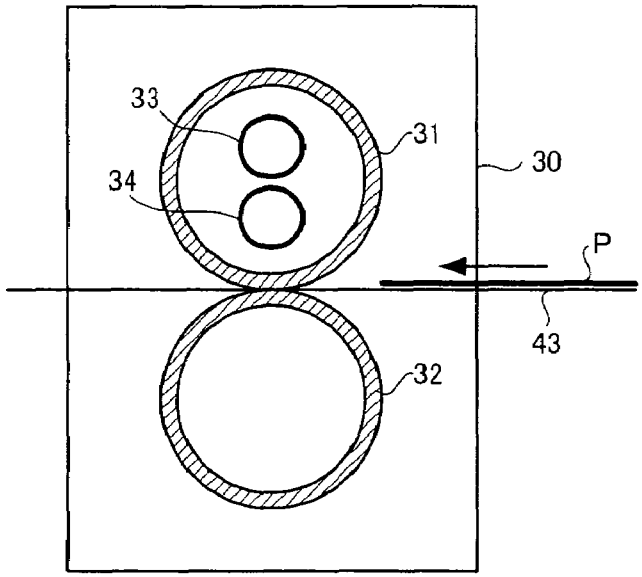
FIG. 2 is a configural diagram describing an example of a fixing device used in the image forming apparatus of the present invention.

FIG. 2 schematically shows the configuration of the fixing device 30. The fixing device 30 is configured by the heat roller 31 for heating and the pressure roller 32, which are cylindrical, causes the pressure roller 32 to contact the heat roller 31, and nips and conveys the paper P. The heat roller 31 includes halogen lamps 33 and 34 as heat sources inside.

Figure 3:
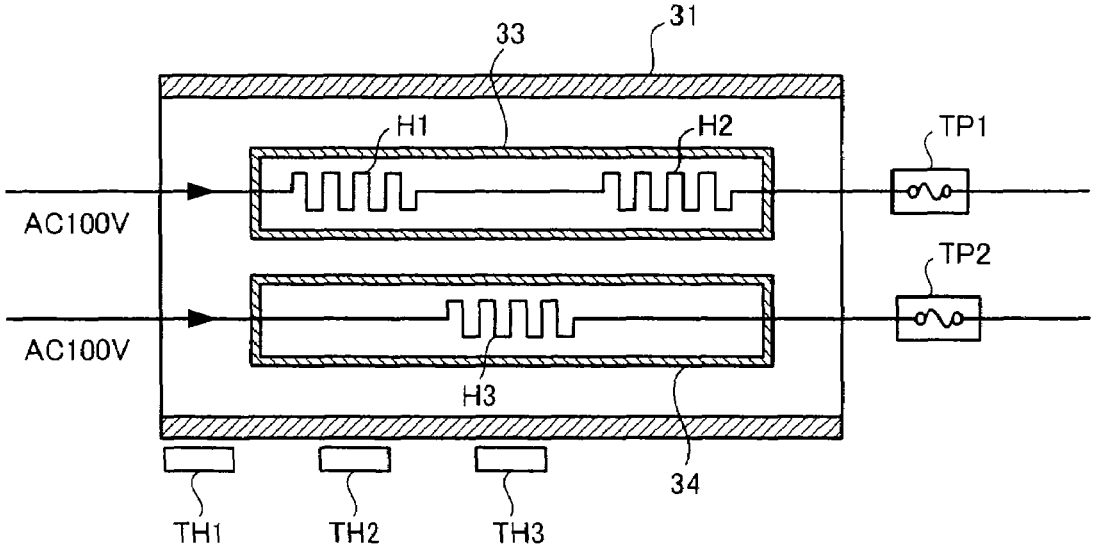
FIG. 3 is a configural diagram describing an example of a heat roller used in the image forming apparatus of the present invention.

FIG. 3 is a configural diagram of the heat roller 31, and mainly shows the configuration of the halogen lamps 33 and 34. The halogen lamp 33 is disposed with heaters H1 and H2 in the vicinity of both end portions of the heat roller 31 in order to heat both sides (both end portions in the axial direction) of the heat roller 31. The halogen lamp 34 is disposed with a heater H3 in the central portion of the heat roller 31 in order to heat the central portion of the heat roller 31.

A thermal protector TP1 is serially connected to the heaters H1 and H2, and voltage (e.g., AC 100 volts) from an alternating current power supply (not shown) is supplied to this serial circuit. Further, a thermal protector TP2 is serially connected to the heater H3, and voltage from the alternating current power supply is supplied to this serial circuit. The thermal protectors TP1 and TP2 are temperature fuses and configured such that the thermal protectors TP1 and TP2 cut off the halogen lamps 33 and 34 when the halogen lamps 33 and 34 emit heat equal to or greater than a stipulated temperature.

Further, temperature detecting elements TH1, TH2 and TH3 are attached in proximity to the heat roller 31. The temperature detecting elements are thermistors, for example. The thermistor TH1 is disposed at a terminal end of the heat roller 31, and the thermistor TH3 is disposed at the central portion of the heat roller 31. Further, the thermistor TH2 is disposed in the middle of the thermistors TH1 and TH3. The thermistors TH1, TH2 and TH3 detect the temperature of the heat roller 31 from its end portion to its central portion.

The reason the three temperature detecting elements TH1, TH2 and TH3 are disposed is to precisely detect the temperature of the heat roller 31. The halogen lamps 33 and 34 inside the heat roller 31 are most susceptible to the affects of outside air at the terminal end sides of the heat roller 31 and less susceptible to the affects of outside air at the central portion.

Figure 4:
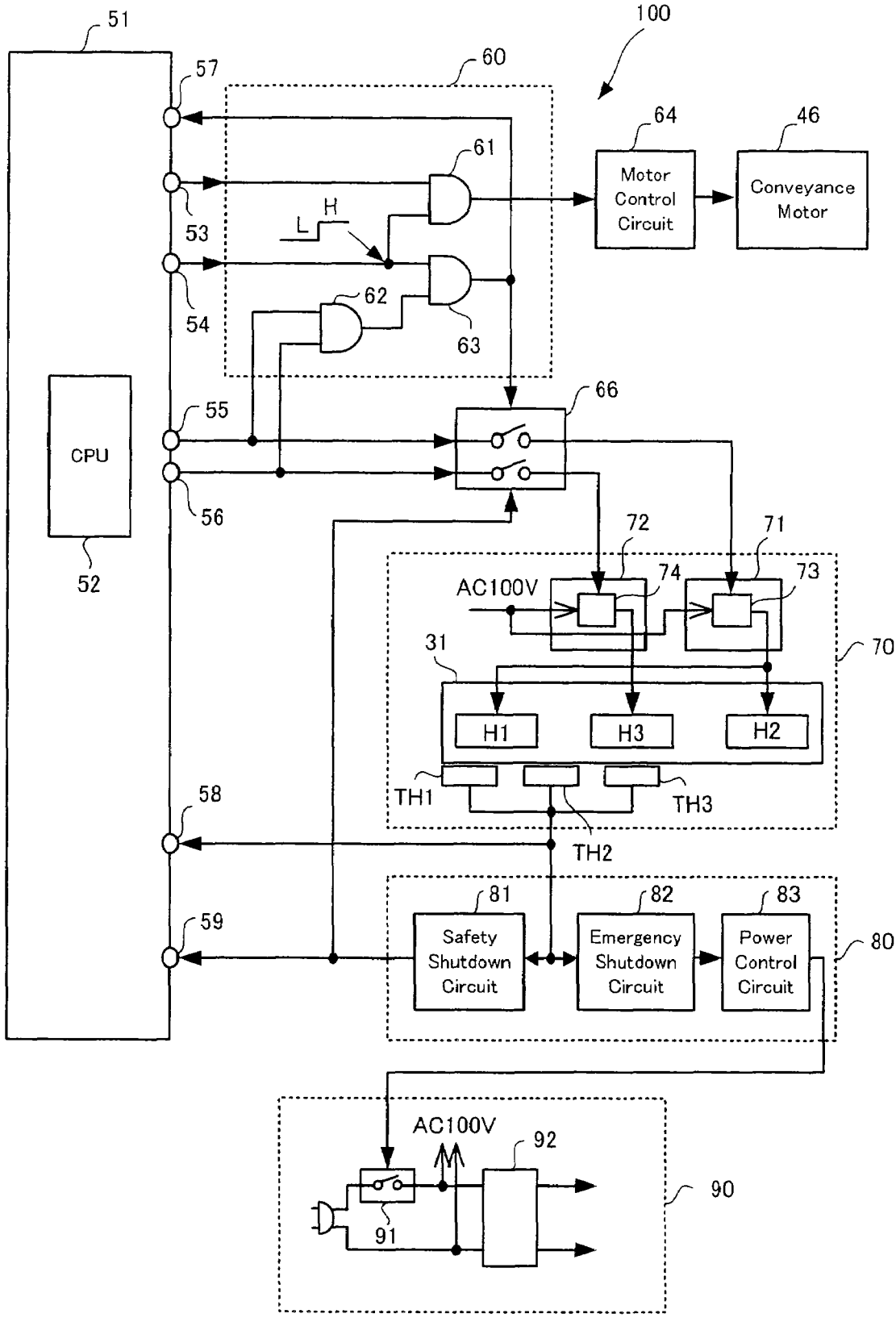
FIG. 4 is a block diagram describing a control system in the embodiment of the image forming apparatus of the present invention.

The image forming apparatus of the present invention is disposed with a control system 100 shown in FIG. 4 in order to shorten warm-up time and increase printing speed and to realize temperature control and power reduction.

In FIG. 4, 51 is a control unit that includes a CPU (Central Processing Unit) 52 and comprises a 1-chip microcomputer, for example. The control unit 51 further includes plural terminals 53 to 59.

First, second and third control circuits 60, 70 and 80 are disposed in the control system 100 of FIG. 4. The first control circuit 60 controls the ON/OFF of the heaters H1 to H3 of the heat roller 31 and the driving of the conveyance motor 46.

The first control circuit 60 includes AND circuits 61, 62 and 63, and a motor control signal outputted from the terminal 53 of the control unit 51 and a mode signal outputted from the terminal 54 are inputted to the AND circuit 61. Heater control signals outputted from the terminals 55 and 56 of the control unit 51 are inputted to the AND circuit 62, and the mode signal outputted from the terminal 54 and an output signal of the AND circuit 62 are inputted to the AND circuit 63. The heater control signal outputted from the terminal 55 is a signal that controls the ON/OFF of the heaters H1 and H2 of the heat roller 31, and the heater control signal outputted from the terminal 56 is a signal that controls the ON/OFF of the heater H3 of the heat roller 31.

An output of the AND circuit 61 is supplied to the conveyance motor 46 via a motor control circuit 64 and controls the driving of the conveyance motor 46. The heater control signals outputted from the terminals 55 and 56 of the control unit 51 are supplied to the second control circuit 70 via a switch 66, and the switch 66 is ON/OFF-controlled by an output signal of the AND circuit 63. Further, the output signal of the AND circuit 63 is supplied to the terminal 57 of the control unit 51.

The second control circuit 70 controls the temperatures of the heaters H1, H2 and H3 of the heat roller 31, and includes a heater controller 71 that controls the heaters H3 at central portion and a heater controller 72 that controls the heater H1 and H2 at the both sides. The heater controllers 71 and 72 ON/OFF-control, with relays 73 and 74, the power voltage (e.g., AC 100 volts) supplied to the heaters H1, H2 and H3, and the heater control signals from the terminals 55 and 56 of the control unit 51 are supplied to the heater controllers 71 and 72 via the switch 66 in order to drive the relays 73 and 74.

The thermistors TH1, TH2 and TH3 are disposed in proximity to the heat roller 31, and the results of the temperature detection (temperature information) by these thermistors TH1, TH2 and TH3 are supplied to the terminal 58 of the control unit 51 and to the third control circuit 80.

The third control circuit 80 is activated when the temperature of the heat roller 31 exceeds a predetermined value on the basis of the temperature information, and includes a safety shutdown circuit 81 and an emergency shutdown circuit 82. The safety shutdown circuit 81 switches OFF the switch 66 when the temperature of the heat roller 31 exceeds a first threshold level.

Further, the emergency shutdown circuit 82 activates a power control circuit 83 to switch OFF a main power switch 91 when the temperature of the heat roller 31 exceeds a second threshold level that is higher than the first threshold level. The output of the safety shutdown circuit 81 is supplied to the terminal 59 of the control unit 51 and notifies the CPU 52 that the safety shutdown circuit 81 has been activated.

The safety shutdown circuit 81 and the emergency shutdown circuit 82 control the heaters H1, H2 and H3 with hardware and operate separately from software control resulting from the CPU 52 of the control unit 51.

The power circuit 90 includes the main power switch 91, which is connected to the alternating current power supply, and a power supply circuit 92, which supplies direct current voltage to each unit in the image forming apparatus, and supplies AC voltage (e.g., 100 volts) to the relays 73 and 74. Further, the main power switch 91 is a power switch including a solenoid, for example, and physically switches OFF the power by activating the solenoid. The main power switch 91 can be manually switched ON and OFF and is configured to be controllable by the output of the power control circuit 83.

Next, the operation of the control system 100 in FIG. 4 will be described. First, the operation of the first control circuit 60 and the second control circuit 70 will be described. In the image forming apparatus of the present invention, in order to realize a shortening of warm-up time and an increase in speed, the heaters H1, H2 and H3 disposed in the fixing device 30 use halogen lamps resulting from ON/OFF control as heat sources, and the conveyance motor 46 has one large capacity motor system.

When the heaters H1, H2 and H3 and the conveyance motor 46 are separately activated by independent control and all of the heaters H1, H2 and H3 and the conveyance motor 46 are activated at once, the instantaneous power consumption ends up increasing remarkably. Thus, in the present invention, the heaters H1, H2 and H3 are switched ON at the same time to shorten the warm-up time in a warm-up mode at the time the power is switched ON, and the driving of the conveyance motor 46 is prohibited so that the power consumption does not exceed the rating in the warm-up mode. In the following description, the heater H3 will be referred to as the center heater, and the heaters H1 and H2 will be referred to as the side heaters.

Figure 5:
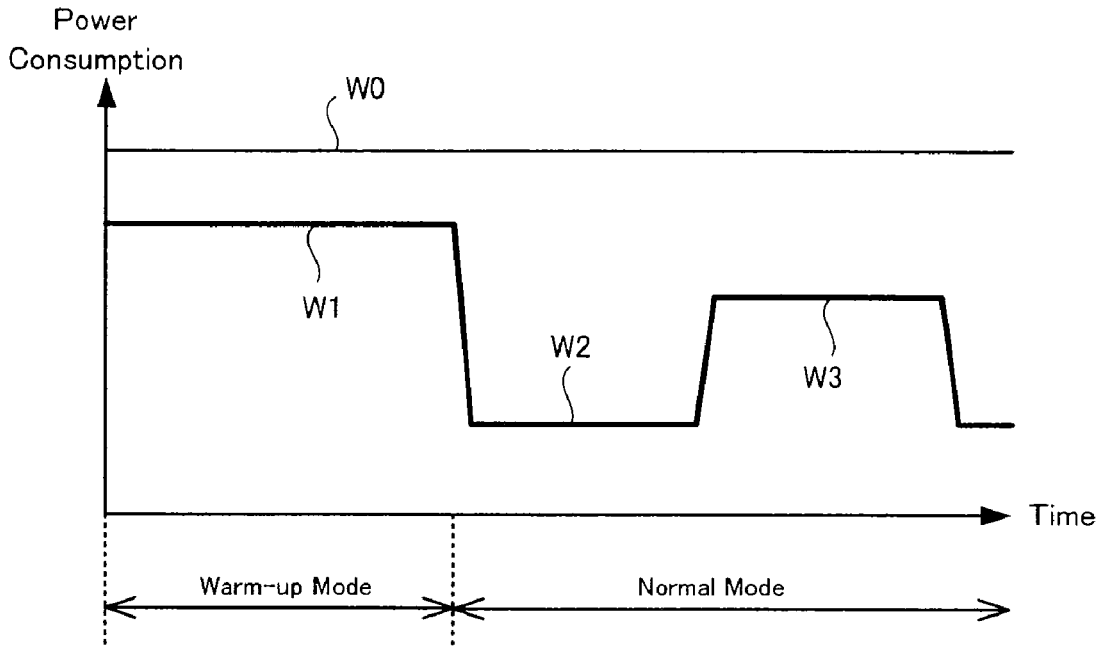
FIG. 5 is an operational descriptive diagram describing the operation of the control system of the image forming apparatus of the present invention.

FIG. 5 is a graph showing the operation of the warm-up mode when the power is switched ON and the normal mode thereafter. As shown in FIG. 5, the warm-up mode begins immediately after the power is switched ON, and thereafter moves to the normal mode. In the warm-up mode, the mode signal is outputted from the terminal 54 of the control unit 51. The mode signal becomes a low level "L" in the warm-up mode and a high level "H" in the normal mode.

In the warm-up mode, a side heater control signal that drives the side heaters H1 and H2 is outputted from the terminal 55 of the control unit 51, and a center heater control signal that drives the center heater H3 is outputted from the terminal 56. These heater control signals switch ON the relays 73 and 74 of the heater control circuits 71 and 72 via the switch 66. At this time, the switch 66 is ON. Thus, the side heaters H1 and H2 and the center heater H3 are switched ON at the same time so that warm-up is completed in a short amount of time.

Further, because power consumption W1 in the warm-up mode is large, it exceeds a rated power W0 of the apparatus 10 when the conveyance motor 46 is also switched ON. For this reason, the running of the conveyance motor 46 is prohibited in the warm-up mode. That is, because the mode signal from the terminal 54 becomes "L" in the warm-up mode, the output of the AND circuit 61 becomes "L" and a signal is not outputted to the motor control circuit 64. Because the output of the AND circuit 63 is also "L" at this time, the switch 66 remains ON and an "L" signal is supplied to the terminal 57 of the control unit 51.

The warm-up mode continues until any of the thermistors TH1, TH2 and TH3 disposed in the heat roller 31 reaches a temperature set beforehand. When any of the thermistors TH1, TH2 and TH3 reaches the set temperature, the control unit 51 ends the warm-up mode and moves to the normal mode on the basis of the temperature information from the thermistors TH1, TH2 and TH3 supplied to the terminal 58.

The movement to the normal mode is conducted by changing the mode signal outputted from the terminal 54 from "L" to "H". Thereafter, the center heater H3 and the side heaters H1 and H2 become unable to be lighted at the same time, so that just either the center heater H3 or the side heaters H1 and H2 can be lighted, and the conveyance motor 46 becomes operable.

That is, in the normal mode, the AND circuit 61 becomes operable because the mode signal from the terminal 54 becomes "H". When the motor control signal is supplied from the terminal 53, the signal is sent to the motor control circuit 64 via the AND circuit 61, and the conveyance motor 46 is driven.

As shown in FIG. 5, in the normal mode, just either the side heaters H1 and H2 or the center heater H3 is switched ON. Thus, the power consumption when the conveyance motor 46 is stopped becomes W2, the power consumption when the conveyance motor 46 is driven becomes W3, and neither exceeds the rated power W0.

In the normal mode, even if the heater control signals are outputted at the same time from the terminals 55 and 56, the switch 66 is switched OFF to prohibit the side heaters H1 and H2 and the center heater H3 from being switched ON at the same time, because the output of the AND circuit 62 becomes "H" and the output of the AND circuit 63 also becomes "H". Consequently, in the normal mode, the switch 66 is switched ON only when a heater control signal is supplied from just one of the terminals 55 and 56.

Further, when the output of the AND circuit 63 becomes "H", the signal is sent to the terminal 57 of the control unit 51. When the control unit 51 receives this signal, the control unit 51 halts the generation of the motor control signal from the terminal 53 and stops the driving of the conveyance motor 46. Consequently, in the normal mode, when a situation occurs where the side heaters and the center heater are switched ON at the same time, the control unit 51 can conduct control to stop the driving of the conveyance motor 46 such that the power consumption does not exceed the rating.

The controlling of the temperature of the fixing device 30 in the normal mode is conducted under the control of the control unit 51 on the basis of the temperature information from the thermistors TH1, TH2 and TH3. That is, in the normal mode, the control unit 51 temporarily switches OFF both the side heaters H1 and H2 and the center heater H3, and when the temperatures of both the side heaters and the center heater fall less than a predetermined value, the control unit 51 first switches ON the heater with the lower temperature. Further, if both the side heaters and the center heater are at exactly the same temperature, then the control unit 51 first switches ON the side heaters H1 and H2 because the potential for the temperature of the heaters close to the outside air to fall is high. Then, the control unit 51 switches OFF the heater that has reached the stipulated temperature. If it is determined at this point in time, by the other temperature information of the thermistors TH1, TH2 and TH3, that there is a portion whose temperature is lower than stipulated, then the control unit 51 switches OFF the heater that had until then been ON and soon switches ON another heater.

Moreover, when the temperature of the fixing device 30 has fallen too low in operation during this time and reaches a temperature where operation is difficult, then the control unit 51 temporarily switches the mode signal to "L", returns to the warm-up mode, switches ON two heaters at the same time, and heats the heaters for a short amount of time. Then, at the point in time when the temperature has risen to the stipulated temperature, the control unit 51 switches the mode signal to "H" and returns to the normal mode. Even in these states, the first control circuit 60 operates in the same manner as at the time of startup and prohibits the conveyance motor 46 from being switched ON during warm-up and prohibits the heaters from being switched ON at the same time in the normal mode.

Further, when the user opens a cover for some reason such as to remove jammed paper, then the control unit 51 immediately switches OFF all of the heaters H1, H2 and H3 in order to ensure safety. Thereby, when the temperature of the fixing device 30 falls to the stipulated temperature or below, then the control unit 51 can begin again from the warm-up mode.

Figure 6:
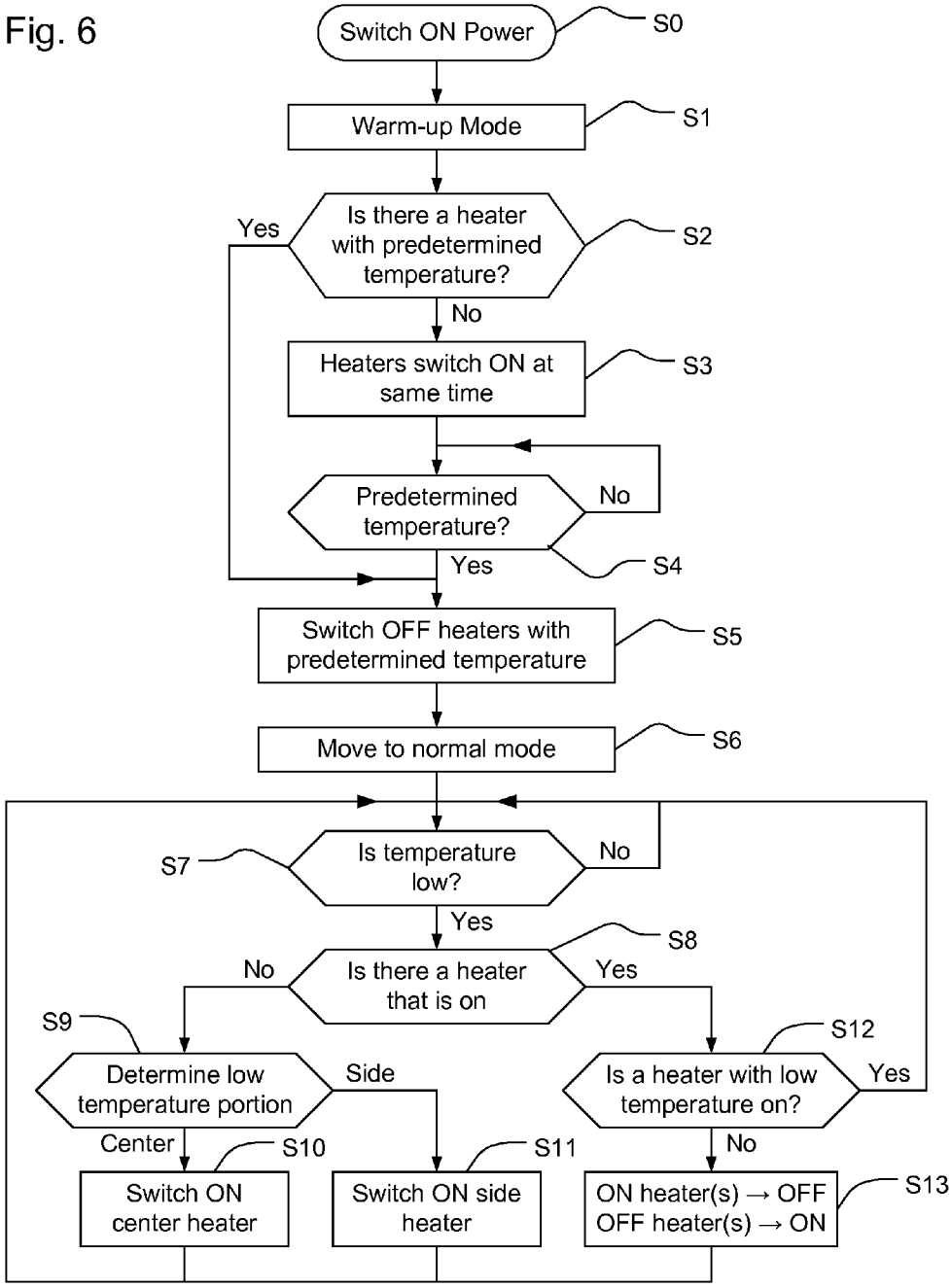
FIG. 6 is a flowchart describing the operation of a first control circuit and a second control circuit in the image forming apparatus of the present invention.

FIG. 6 is a flowchart showing the heater control operation described above in the warm-up mode and in the normal mode. In FIG. 6, step S0 to step S5 are steps in the warm-up mode, and step S6 to step S13 are steps in the normal mode.

When the power is switched ON in step S0, then the control unit 51 sets the mode to the warm-up mode in step S1 and outputs the "L" mode signal. In step S2, the control unit 51 checks the temperatures of the heaters to see whether or not there is a heater whose temperature has already reached the predetermined temperature. If there is a heater whose temperature has already reached the predetermined temperature, then the control unit 51 moves to step S6, and if there is not a heater whose temperature has already reached the predetermined temperature, then the control unit 51 moves to step S3.

In step S3, the control unit 51 outputs the heater control signals that cause the center heater H3 and the side heaters H1 and H2 to be switched ON at the same time. In step S4, the control unit 51 determines whether or not the temperatures of the heaters have reached the predetermined value on the basis of the temperature information of the thermistors TH1, TH2 and TH3, when the temperatures of the heaters reached the predetermined value, in step S5, the control unit 51 switches OFF the heaters H1 and H2 or H3 with the predetermined temperature. In step S6, the control unit 51 moves to the normal mode and switches the mode signal to "H" to allow the driving of the conveyance motor 46, whereby the driving of the conveyance motor 46 by the motor control signal becomes possible.

Next, in step S7, the control unit 51 determines the temperature of the fixing device 30 on the basis of the temperature information of the thermistors TH1, TH2 and TH3. When the temperature of the fixing device 30 is lower than the stipulated temperature, then in step S8 the control unit 51 checks if there are heaters that are ON. When there are no heaters that are ON, then in step S9 the control unit 51 determines which portion of the fixing device 30 has a low temperature, and when the temperature of the central portion is low, then in step S10 the control unit 51 switches ON just the center heater H3. Further, in step S9, when the control unit 51 determines that the temperature of both sides of the fixing device 30 is low, then in step S11 the control unit 51 switches ON just the side heaters H1 and H2.

In step S8, when there is a heater that is ON, then the control unit 51 moves to step S12. In step S12, the control unit 51 determines whether or not the heater at the portion with the low temperature is ON. If the answer is YES, then the control unit 51 continues keeping that heater ON and returns to step S7. If the answer is NO in step S12, then the control unit 51 switches OFF the heater that is ON and conversely switches ON the heater that is OFF.

In this manner, the control unit 51 switches ON and OFF the heaters by returning to step S7 after steps S10, S11, S12 and S13. Thus, the control unit 51 can switch ON just the center heater or the side heaters without having to switch ON both the center heater and the side heaters at the same time, and can control the temperature of the fixing device 30 at a uniform temperature regardless of both sides and the center portion.

When paper of different sizes passes through the fixing device 30, and particularly when paper with a small size passes through the fixing device 30, the paper contacts the center portion of the fixing device 30 but does not contact both end portions of the fixing device 30. Thus, the temperature of the end portions becomes relatively high. Even in such a case, the control unit 51 can control the temperature of the fixing device 30 at a uniform temperature by appropriately controlling the temperatures of the center heater H3 and the side heaters H1 and H2.

Next, the operation resulting from the third control circuit 80 will be described. When the capacity of the heaters is increased in order to achieve warm-up in a short amount of time, then in a delay in the control by the control unit 51, bugs, or smoke or fire when a malfunction occurs, increases. For this reason, in the present invention, the third control circuit 80 is disposed in order to ensure the safety of the heaters even if a bug or malfunction arises.

The third control circuit 80 includes the safety shutdown circuit 81 and the emergency shutdown circuit 82, and operates independently of the control of the control unit 51. The safety shutdown circuit 81 is a circuit that prevents a current exceeding the rated current from flowing through the heaters, and the emergency shutdown circuit 82 is a circuit that prevents a current exceeding the rated current from flowing through the heaters and prevents the heaters from abnormally overheating.

For this reason, the third control circuit 80 supplies the temperature information of the thermistors TH1, TH2 and TH3 to the safety shutdown circuit 81 and controls the switch 66 with the output of the safety shutdown circuit 81. The safety shutdown circuit 81 ignores the control of the control unit 51, and switches OFF the switch 66 by means of hardware to switch OFF the heaters H1, H2 and H3 forcibly when any one of the thermistors exceeds the normal temperature range and becomes equal to or greater than the preset first threshold.

A set constant temperature is set on the basis of experimental results, and the first threshold is a temperature that can be safely restored even though it is outside the range of normal operation. The safety shutdown circuit 81 forcibly switches OFF the heaters, conveys via the terminal 59 of the control unit 51 the fact that the mode has entered the safety shutdown mode, and waits for the heaters to cool. When the control unit 51 is notified of the fact that the mode has entered the safety shutdown mode, then the control unit 51 temporarily stands by until the heaters cool. When the temperatures of the heaters have become cool and returned to the normal temperature range, then the control unit 51 conducts control to move to the normal mode.

Further, the emergency shutdown circuit 82 is a circuit that switches OFF the entire apparatus, regardless of the control of the control unit 51, when the temperatures detected by the thermistors TH1, TH2 and TH3 have exceeded the first threshold and become equal to or greater than the second threshold. When even one of the thermistors TH1, TH2 and TH3 exceeds a dangerous temperature, then the mode is immediately switched to the emergency shutdown mode regardless of the current state. At this time, the power control circuit 83 switches OFF the main power switch 91 of the power circuit 90 and shuts down the entire apparatus. Thus, fire/smoke can be avoided.

Figure 7:
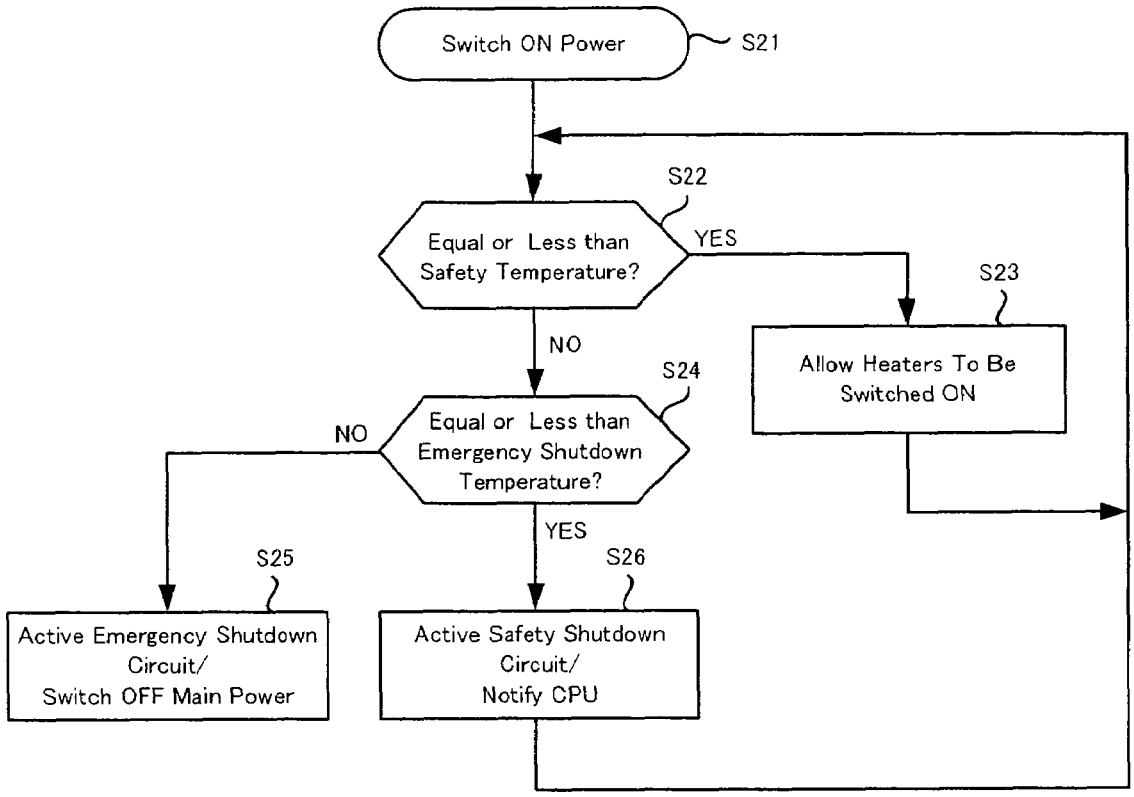
FIG. 7 is a flowchart describing the operation of a third control circuit in the image forming apparatus of the present invention.

FIG. 7 is a flowchart showing the control operation by the third control circuit 80 described above. When the power is switched ON in step S21 of FIG. 7, then in step S22 it is determined whether or not the temperature of the fixing device 30 is equal to or less than a safe temperature on the basis of the temperature information from the thermistors TH1, TH2 and TH3. When the temperature of the fixing device 30 is equal to or less than the safe temperature, then in step S23 the third control circuit 80 generates a signal allowing the heaters to be ON and maintains the switch 66 in the ON state.

When it is determined in step S22 that the temperature of the fixing device 30 exceeds the safe temperature range, then the third control circuit 80 moves to step S24. In step S24, it is determined whether or not the temperature of the fixing device 30 is equal to or less than an emergency shutdown temperature (second threshold) When it is determined in step 24 that the temperature of the fixing device 30 exceeds the emergency shutdown temperature (NO), then the emergency shutdown circuit 82 is activated in step S25 to switch OFF the main power switch 91. In this state, because the temperature of the fixing device 30 has already reached a dangerous temperature, the power of the apparatus 10 is switched OFF and thereafter a serviceman is called.

When it is determined in step S24 that the temperature of the fixing device 30 is equal to or less than the emergency shutdown temperature (YES), then the safety shutdown circuit 81 is activated in step S26 to switch OFF the switch 66 and switch OFF all of the heaters H1, H2 and H3. Further, the safety shutdown circuit 81 conveys to the CPU 52 of the control unit 51 the fact that the mode has entered the safety shutdown mode and waits for the heaters to cool. After the heaters have been switched OFF in step S26, then the third control circuit 80 returns to step S22, checks whether the temperature of the fixing device 30 is a safe temperature, and thereafter operates in accordance with the flowchart.

Figure 8:
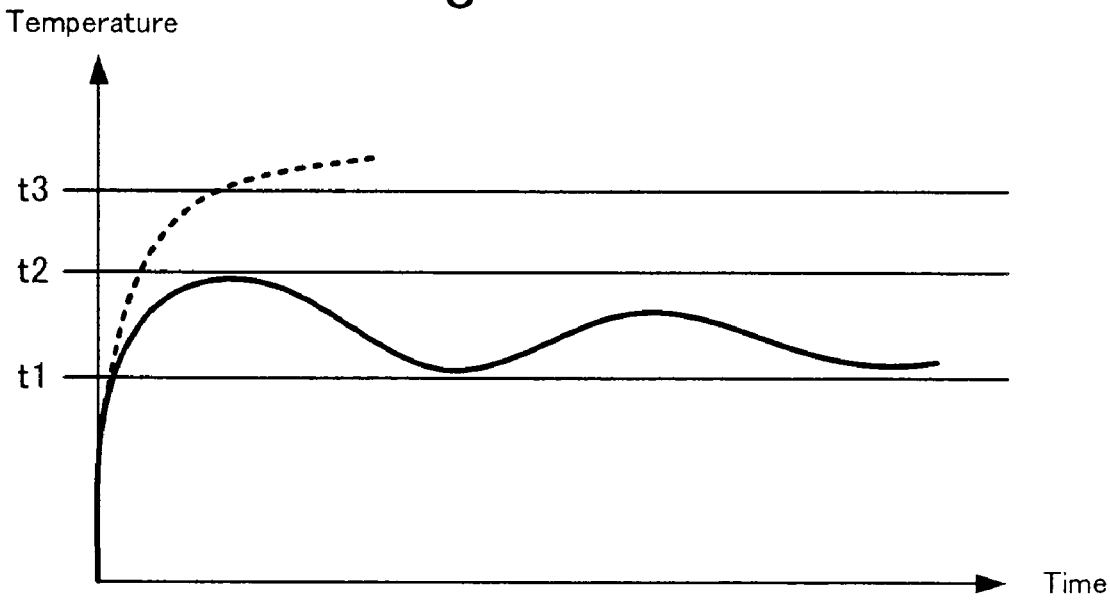
FIG. 8 is a descriptive diagram describing the operation of temperature control in the image forming apparatus of the present invention.

FIG. 8 schematically shows the operation of the control circuits 60, 70 and 80 with respect to a rise in the temperature of the fixing device 30, with the vertical axis representing temperature. In FIG. 8, in the initial state after the power has been switched ON, two heaters are switched ON at the same time and the temperature rises. When the temperature exceeds the predetermined value t1, then the control circuits 60 and 70 ON-control either the center heater or the side heaters under the control of the control unit 51 and control the heaters such that the temperature is within the stipulated temperature range (during the time from t1 to t2).

When the temperature rises and exceeds the first threshold t2, then the safety shutdown circuit 81 of the control circuit 80 is activated to switch OFF the heaters. Further, if the temperature exceeds the second threshold t3, then the emergency shutdown circuit 82 is activated to switch OFF the main power switch 91 and shuts down the operation of the entire apparatus.

In this manner, in the present invention, because control in three stages is conducted, rises in temperature can be reliably suppressed and safety can be improved even when a bug or malfunction arises in the control unit 51.

Further, as described in FIG. 3, the thermal protectors TP1 and TP2 are serially connected to the heaters H1, H2 and H3. For this reason, when the halogen lamps 33 and 34 emit heat equal to or greater than the stipulated temperature, then thermal protectors TP1 and TP2 cut them off, double protection is implemented, and safety is further improved. Further, in the normal mode, high-speed processing of the image forming apparatus becomes possible because sufficient power can be supplied to the conveyance motor 46.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. An image forming apparatus comprising:

a conveyance motor for conveying paper;

an image forming unit forms a toner image on the conveyed paper;

a fixing device having a heat roller including plural heat sources and a pressure roller disposed facing the heat roller, the fixing device causing the toner image to be fixed to the paper;

a control unit generates first control signals that switch ON or OFF the plural heat sources and a second control signal that controls the driving of the conveyance motor, and generates a mode signal that differs between a warm-up mode and a normal mode; and a first control circuit including:

a first AND circuit to which the first control signals for separately switching ON the plural heat sources are inputted, a second AND circuit to which the mode signal and an output signal of the first AND circuit are inputted, and a third AND circuit to which the second control signal that controls the driving of the conveyance motor and the mode signal are inputted, wherein the supply of the first control signals to the plural heat sources is controlled by the output of the second AND circuit and the supply of the second control signal to the conveyance motor is controlled by the output of the third AND circuit, wherein the first control circuit switches ON the plural heat sources at the same time and prohibits the driving of the conveyance motor during the warm-up mode, and allows the driving of the conveyance motor and prohibits all of the plural heat sources from being switched ON at the same time during the normal mode.

2. The image forming apparatus according to claim 1, wherein power consumption when the plural heat sources are switched ON at the same time during the warm-up set such that it becomes equal to or less than the rated power of the image forming apparatus.

3. The image forming apparatus according to claim 1, wherein any one of the plural heat sources is controlled to be ON during the normal mode, and the sum of the power consumption of the heat sources is ON and the power consumption resulting from the driving of the conveyance motor is set such that it becomes equal to or less than the rated power of the image forming apparatus.

4. The image forming apparatus according to claim 1, wherein the plural heat sources comprise halogen lamps to which AC power is supplied via relays, and the relays are ON/OFF-controlled by the first control signals.

5. The image forming apparatus according to claim 1, wherein the heat sources comprise a center heater includes a first heater that heats a center portion of the heat roller and side heaters includes second and third heaters that heat both sides of the heat roller.

6. The image forming apparatus according to claim 1, wherein a switch means is disposed in a line that supplies the first control signals to the plural heat sources, the switch means being controlled by the output of the second AND circuit, and in the normal mode, the switch means is switched OFF when control signals that switch ON the plural heat sources are generated at the same time.

7. The image forming apparatus according to claim 1, wherein the control unit shuts down the generation of the second control signal with the output of the first AND circuit when control signals that switch ON the plural heat sources are generated at the same time.

8. An image forming apparatus comprising:

a conveyance motor for conveying paper;

an image forming unit forms a toner image on the conveyed paper;

a fixing device having a heat roller including plural heat sources and a pressure roller disposed facing the heat roller, the fixing device causing the toner image to be fixed to the paper;

a control unit generates first control signals that switches ON or OFF the heat sources and a second control signal that controls the driving of the conveyance motor, and generates a mode signal that differs between a warm-up mode and a normal mode;

a first control circuit including:

a first AND circuit to which the first control signals for separately switching ON the plural heat sources are inputted, a second AND circuit to which the mode signal and an output signal of the first AND circuit are inputted, and a third AND circuit to which the second control signal that controls the driving of the conveyance motor and the mode signal are inputted, wherein the supply of the first control signals to the plural heat sources is controlled by the output of the second AND circuit and the supply of the second control signal to the conveyance motor is controlled by the output of the third AND circuit, wherein the first control circuit switches ON the plural heat sources at the same time and prohibits the driving of the conveyance motor during the warm-up mode, and allows the driving of the conveyance motor and prohibits all of the plural heat sources from being switched ON at the same time during the normal mode;

a temperature detecting means detect the temperature of the fixing device;

a second control circuit controls the supply of the first control signals to the plural heat sources and controls the temperature of the fixing device on the basis of the detection result of the temperature detecting means in the normal mode; and a third control circuit includes a first shutdown circuit that shuts down the first control signals supplied to the heat sources when the temperature of the fixing device exceeds a first threshold and a second shutdown circuit that shuts down the supply of power to the image forming apparatus when the temperature of the fixing device exceeds a second threshold that is higher than the first threshold.

9. The image forming apparatus according to claim 8, wherein the heat sources comprise a center heater includes a first heater heats a center portion of the heat roller and side heaters include second and third heaters heat both sides of the heat roller, the temperature detecting means comprise temperature detecting elements detect the temperatures of at least the center portion and both sides of the heat roller, and the control unit switches ON either the center heater or the side heaters and generates the first control signals such that the temperature of the heat roller becomes a predetermined value on the basis of the detection result of the temperature detecting means.

10. A method of controlling an image forming apparatus having a conveyance motor for conveying paper, an image forming unit forms a toner image on the conveyed paper, and a fixing device including plural heat sources for causing the toner image to be fixed to the paper, the method comprising:

a first step of setting the plural heat sources in a warm-up mode and generating a warm-up mode signal;

a second step of switching ON the plural heat sources at the same time by a first AND output of first control signals that individually switch ON the plural heat sources and the warm-up mode signal in the warm-up mode;

a third step of prohibiting the driving of the conveyance motor by a second AND output of the warm-up mode signal and a second control signal that controls the driving of the conveyance motor in the warm-up mode;

a fourth step of moving from the warm-up mode to a normal mode when the temperature of the fixing device reaches a predetermined value in the warm-up mode and generating a normal mode signal;

a fifth step of allowing the driving of the conveyance motor by a third AND output of the second control signal and the normal mode signal in the normal mode; and a sixth step of prohibiting all of the plural heat sources being switched ON at the same time by a fourth AND output of the first control signals and the normal mode signal in the normal mode.

11. The image forming apparatus control method according to claim 10, wherein the fourth step includes a step of detecting the temperature of the fixing device and receiving the temperature detection result, and a step of alternately switching ON any one of the plural heat sources to stabilize the temperature of the fixing device in response to the temperature detection result.

12. The image forming apparatus control method according to claim 10, wherein the heat sources comprise a center heater includes a first heater that heats a center portion of the fixing device and side heaters include serially connected second and third heaters that heat both sides of the fixing device, and in the fourth step, either the center heater or the side heaters is alternately switched ON to stabilize the temperature of the fixing device.

* * * * *